US009796175B2

(12) United States Patent
Sponer et al.

(10) Patent No.: US 9,796,175 B2
(45) Date of Patent: Oct. 24, 2017

(54) CONTROLLER TO INSERT PRINT IMAGE-DEPENDENT PREFIRE PULSES IN AN INKJET PRINTING SYSTEM

(71) Applicant: Océ Holding B.V., Venlo (NL)

(72) Inventors: Timo Sponer, Markt Schwaben (DE); Martin Wilhelm, Maitenbeth (DE)

(73) Assignee: Océ Holding B.V., Venlo (NL)

( * ) Notice: Subject to any disclaimer, the term of this patent is extended or adjusted under 35 U.S.C. 154(b) by 0 days.

(21) Appl. No.: 15/398,024

(22) Filed: Jan. 4, 2017

(65) Prior Publication Data

US 2017/0190171 A1 Jul. 6, 2017

(30) Foreign Application Priority Data

Jan. 4, 2016 (DE) ..... 10 2016 100 036

(51) Int. Cl.
*B41J 2/045* (2006.01)

(52) U.S. Cl.
CPC ..... *B41J 2/0451* (2013.01); *B41J 2/04586* (2013.01); *B41J 2/04596* (2013.01); *B41J 2/04598* (2013.01)

(58) Field of Classification Search
CPC .... B41J 2/0451; B41J 2/04586; B41J 2/0459; B41J 2/04593; B41J 2/04573; B41J 2/0458; B41J 2/04563; B41J 2/04528; B41J 2/04578; B41J 2/04591
See application file for complete search history.

(56) References Cited

U.S. PATENT DOCUMENTS 6,412,925 B1 * 7/2002 Takahashi ..... B41J 2/04571 347/11

FOREIGN PATENT DOCUMENTS

EP 2837497 A2 2/2015

* cited by examiner

*Primary Examiner* — Thinh H Nguyen
(74) *Attorney, Agent, or Firm* — Schiff Hardin LLP

(57) ABSTRACT

A controller adapted for an inkjet printing system is described. The controller can include an analyzer and a prefire inserter. The analyzer can be configured to determine whether a nozzle arrangement should generate a fire pulse in a current line, and whether the last preceding fire pulse was further in the past than an interval value threshold N. The prefire inserter can be configured to insert one or more prefire pulses into the N lines before the current line.

18 Claims, 7 Drawing Sheets

CONTROLLER TO INSERT PRINT IMAGE-DEPENDENT PREFIRE PULSES IN AN INKJET PRINTING SYSTEM

CROSS REFERENCE TO RELATED APPLICATIONS

This patent application claims priority to German Patent Application No. 102016100036.1, filed Jan. 4, 2016, which is incorporated herein by reference in its entirety.

BACKGROUND

The disclosure is directed to a device and method to insert print image-dependent prefire pulses in an inkjet printing system.

Inkjet printing systems may be used to print to recording media (such as paper, for example). For this, a plurality of nozzles may be used in order to fire or push ink droplets onto the recording medium, and thus in order to generate a desired print image on the recording medium.

During printing, print quality problems (for example an incorrect positioning of an ink droplet or a nozzle failure) may occur depending on the type of ink that is used and/or depending on the print speed and/or depending on the ejected droplet size per nozzle. These print quality problems typically arise due to the increase of the viscosity of the ink in the nozzle. In particular, what are known as first line effects—in which print dots may no longer be placed in a targeted manner on the recording medium by a nozzle, or the nozzle fails completely—may occur after longer print pauses due to the viscosity change of the ink in a nozzle.

Prefire pulses can be used to reduce and/or eliminate quality issues. Prefire pulses produce a stirring of the ink in the nozzle channel of a nozzle arrangement immediately behind the nozzle opening, and thus prevent a drying out of a nozzle arrangement that has not been used for a period of time. No (non-white) print dots are generated on the paper by prefire pulses.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 4:
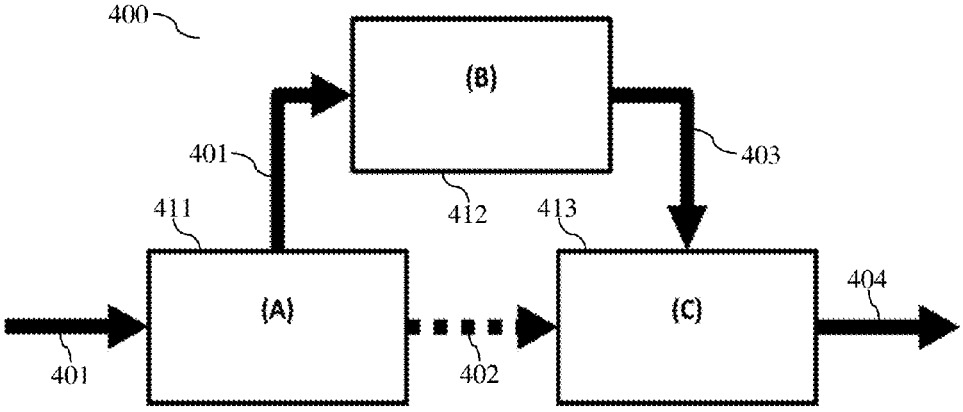
FIG. 4 illustrates a controller according to an exemplary embodiment of the present disclosure.
Figure 6A:
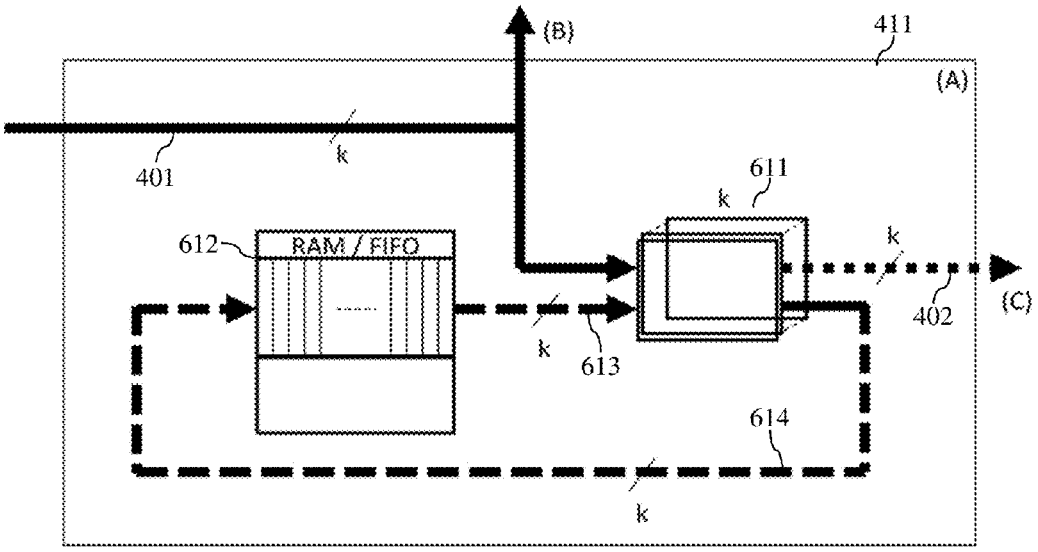
Figure 6B:
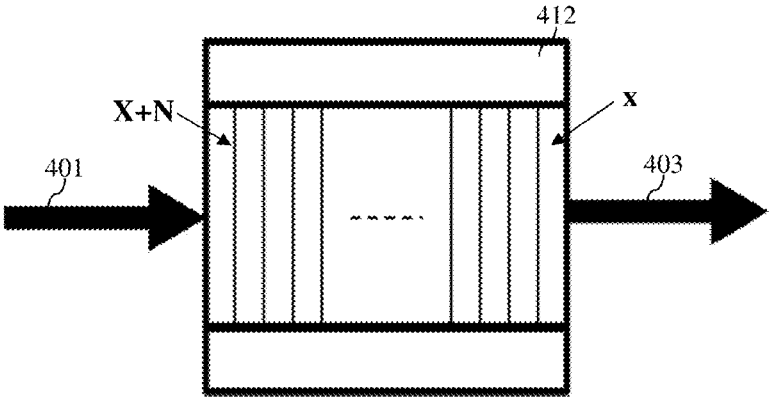
Figure 6C:
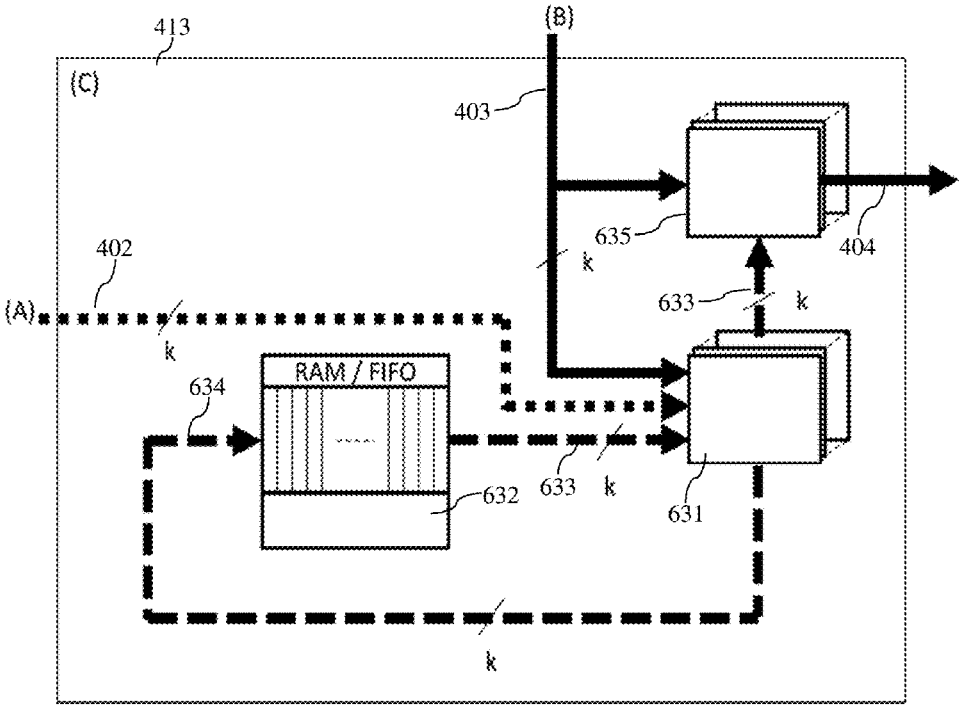

FIGS. 6*a*-6*c* illustrate exemplary embodiments of the controller of FIG. 4.

Figure 7A:
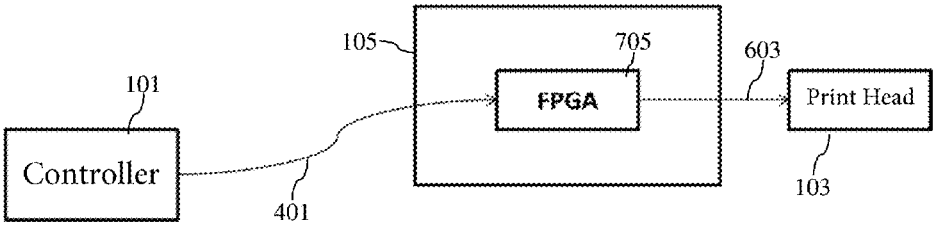
Figure 7B:
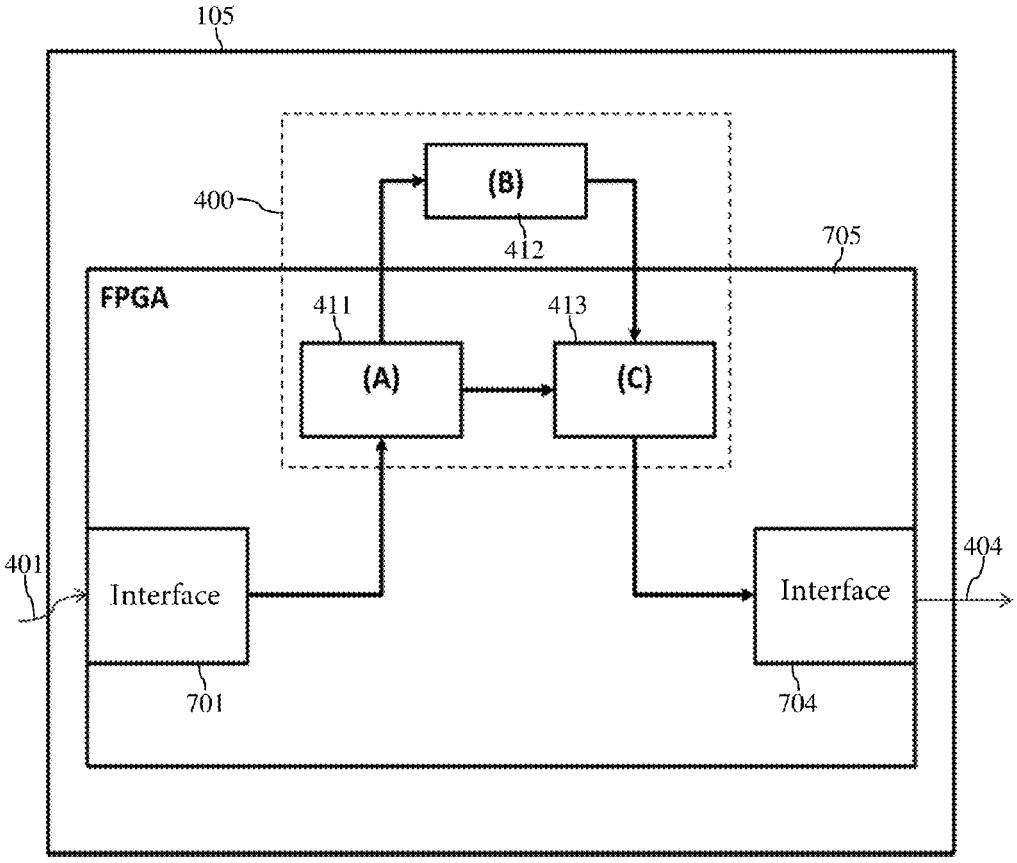

FIGS. 7*a* & 7*b* illustrate a printing system including a controller according to an exemplary embodiment of the present disclosure.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure includes, among other things, providing a controller and a corresponding method that enable an effective use of prefire pulses in order to increase the print quality of an inkjet printing system.

An exemplary embodiment of the present disclosure includes a controller configured for use in a print head of an inkjet printing system. The print head can include at least one nozzle arrangement. In an exemplary embodiment, the controller comprises an analyzer that is configured to analyze basic print data for a rastered image to detect a current line of a sequence of lines of said rastered image in which the nozzle arrangement should generate a fire pulse, and for which an interval value of directly preceding lines of the sequence of lines in which the nozzle arrangement should have generated no fire pulse is greater than a predefined interval value threshold N. In an exemplary embodiment, the controller additionally comprises a data buffer that is configured to delay the basic print data by N lines in order to provide delayed print data. In an exemplary embodiment, the controller comprises a prefire inserter that is configured to determine print data modified on the basis of the delayed print data for a past line of the sequence of lines that is situated up to N lines before the current line, such that the modified print data induce the nozzle arrangement to generate a prefire pulse for the past line.

In an exemplary embodiment, an inkjet printing system is described that comprises a controller according to one or more of the exemplary embodiments of the present disclosure.

In an exemplary embodiment, a method is described for increasing the print quality in an inkjet printing system. The inkjet printing system can comprises a nozzle arrangement. In an exemplary embodiment, the method includes the analysis of basic print data for a rastered image to detect a current line of a sequence of lines of the rastered image in which the nozzle arrangement should generate a fire pulse, and for which an interval value of directly preceding lines of the sequence of lines in which the nozzle arrangement should have generated no fire pulse is greater than a predefined interval value threshold N. In an exemplary embodiment, the method additionally includes the delaying of the basic print data by N lines in order to provide delayed print data. In an exemplary embodiment, the method includes the determination of modified print data on the basis of delayed print data for at least one past line of the sequence of lines that is situated up to N lines before the current line, such that the modified print data induce the nozzle arrangement to generate a prefire pulse for the past line.

Figure 1:
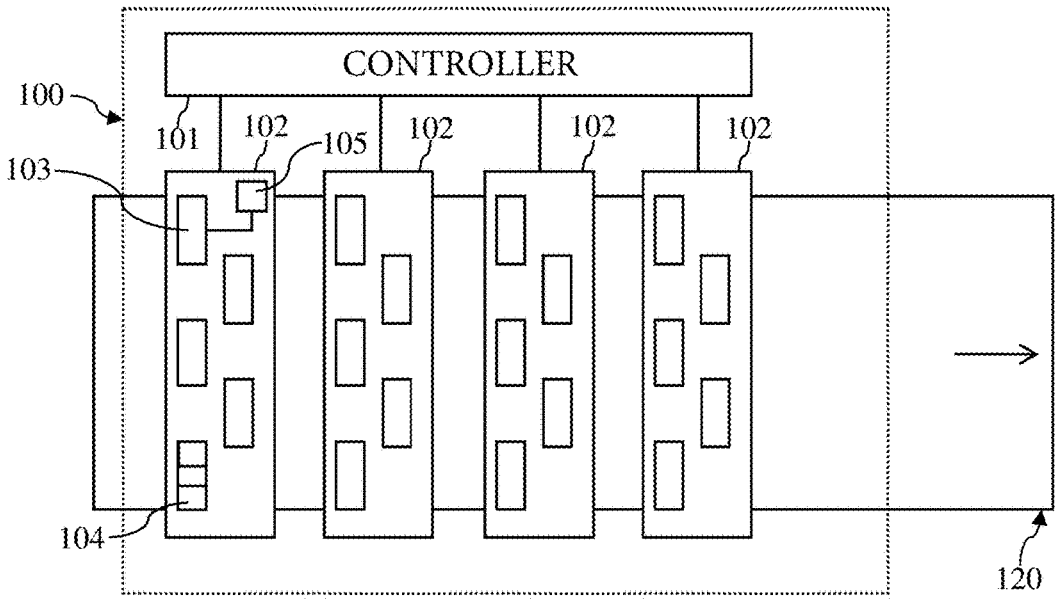
FIG. 1 illustrates a block diagram of an inkjet printing system according to an exemplary embodiment of the present disclosure.

FIG. 1 illustrates a block diagram of an inkjet printing system 100 according to an exemplary embodiment of the present disclosure. The printing system 100 can be configured to print to a web-shaped recording medium 120 (also designated as a "continuous feed"). However, the embodiments are also applicable to printing systems configured to print to sheet-shaped recording media. A web-shaped recording medium 120 is typically unspooled from a roll (the take-off) and then supplied to the print group of the printing system 100. A print image is applied to the recording medium 120 via the print group, and after fixing/drying of the print image, the printed recording medium 120 is taken up again on an additional roll (the take-up) again or cut into sheets. In FIG. 1, the transport direction of the recording medium 120 is represented by an arrow (in the right direction relative to the drawing). The recording medium 120 may be produced from paper, paperboard, cardboard, metal, plastic, textiles and/or other suitable and printable materials.

In the depicted example, the print group of the printing system 100 comprises four print head arrangements 102 (that are also respectively designated as print bars), but is not limited thereto. The different print head arrangements 102 may be used for printing with inks of different colors (for example black, cyan, magenta and/or yellow). The print group may comprise further additional print head arrangements 102 for printing with additional colors or additional inks (for example MICR ink).

In an exemplary embodiment, a print head arrangement 102 comprises one or more print heads 103. For example, a print head arrangement 102 can include five respective print heads 103. Each print head 103 may in turn be subdivided into a plurality of print head segments 104, wherein each print head segment 104 can include a plurality of nozzles or, respectively, nozzle arrangements.

The installation position/orientation of a print head 103 within a print head arrangement 102 may depend on the type of print head 103. In an exemplary embodiment, one or more of the print heads 103 include one or more nozzles and/or nozzle arrangements that may be arranged in different segments 104. The nozzle(s) can be configured to fire or spray ink droplets onto the recording medium 120. For example, a print head 103 may comprise 2558 effectively utilized nozzles that are arranged along one or more rows transversal to the travel direction of the recording medium 120, but are not limited thereto. The nozzles in the individual rows may be arranged offset from one another. A respective line on the recording medium 120 may be printed transversal to the travel direction using the nozzles of a print head 103. An increased resolution may be provided via the use of a plurality of rows with (transversally offset) nozzles. In total, K=12790 droplets may thus be sprayed onto the recording medium 120 along a transversal line by a print head arrangement 102 depicted in FIG. 1 (for example for a print width of approximately 21.25 inches with 600 dpi (dots per inch). In other words, a print head arrangement 102 may comprise K (for example K=12790) nozzles for printing of a line (or transversal line) of a print image. Each print head arrangement 102 may thus be configured to print a transversal line of a defined color on the recording medium 120 at a defined point in time.

In an exemplary embodiment, the printing system 100 includes a controller 101. The controller 101 can be an activation hardware in one or more embodiments. In an exemplary embodiment, the controller 101 is configured to activate one or more actuators of the nozzle arrangements of the print heads 103 to apply a print image onto the recording medium 120. The controller 101 can be configured to activate the actuator(s) based on the print data. In an exemplary embodiment, the controller 101 includes processor circuitry that is configured to perform one or more functions and/or operations of the controller 101, including activating the actuator(s) based on the print data.

In an exemplary embodiment, the printing system 100 includes K nozzle arrangements that may be activated with a defined activation frequency to print a line (transversal to the transport direction of the recording medium 120) with K pixels or K columns on the recording medium 120. In an exemplary embodiment, the activation frequency depends on the print speed (number of printed lines per time unit) of the printing system 100.

In an exemplary embodiment, the nozzle arrangements are immovably or firmly plugged into the printing system 100, and the recording medium 120 is directed at a specific transport velocity past the stationary nozzle arrangements. A specific nozzle arrangement thus prints a correspondingly determined column (in the transport direction) onto the recording medium 120 (in a one-to-one association). In an exemplary embodiment, at most one ink ejection is performed via a defined nozzle arrangement per line of a print image. The time period in which no ink ejection by a defined nozzle arrangement has taken place consequently results directly from the number of lines in which no "white" pixel is to be printed in a specific column, and from the (possibly constant) print speed. This time is also designated in this document as non-printing time (NPT) or dead time.

Figure 2:
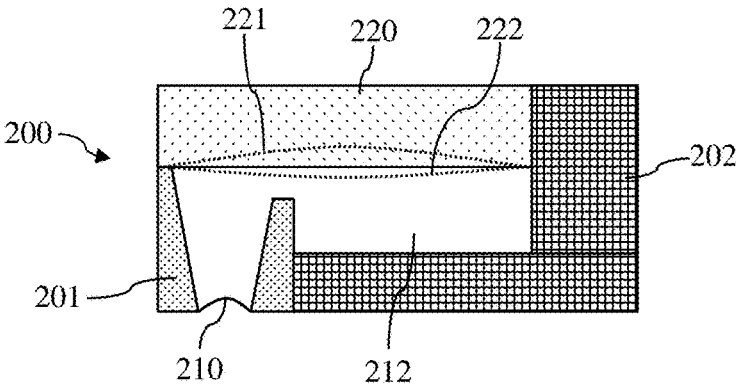
FIG. 2 illustrates an inkjet nozzle arrangement according to an exemplary embodiment of the present disclosure.

FIG. 2 illustrates a nozzle arrangement 200 of a print head 103 according to an exemplary embodiment of the present disclosure. In an exemplary embodiment, the nozzle arrangement 200 comprises walls 202 which, together with an actuator 220 and a nozzle 201, form a receptacle or chamber 212 to receive ink. An ink droplet may be sprayed onto the recording medium 120 via the nozzle 201 of the nozzle arrangement 200. The ink forms what is known as a meniscus 210 at the nozzle 201. In an exemplary embodiment, the nozzle arrangement 200 comprises the actuator 220 (for example a piezoelectric element) that is configured to vary the volume of the chamber 212 to receive ink or, respectively, to vary the pressure in the chamber 212 of the nozzle arrangement 200. In particular, the volume of the chamber 212 may be reduced, and the pressure in the chamber 212 increased, by the actuator 220 as a result of a deflection 222. An ink droplet is thus pushed out of the nozzle arrangement 200 via the nozzle 201. FIG. 2 shows a corresponding deflection 222 (dotted line) of the actuator 220. Moreover, the volume of the chamber 212 may be increased via the actuator 220 (see deflection 221) in order to draw new ink into the receptacle or chamber 212 via an inlet.

The ink 212 within the nozzle arrangement 200 may thus be moved, and the chamber 212 may be put under pressure, via a deflection 221, 222 of the actuator 220. A defined movement of the actuator 220 thereby produces a correspondingly defined movement of the ink. In an exemplary embodiment, the defined movement of the actuator 220 is produced via a corresponding waveform or a corresponding specific pulse of an activation signal of the actuator 220. For example, via a fire pulse (also designated as an ejection pulse) to activate the actuator 220, the nozzle arrangement 200 ejects an ink droplet via the nozzle 201. Different ink droplets may be ejected via different activation signals to the actuator 220. In particular, the ink droplets may be ejected with different droplet size (for example 5 pl, 7 pl or 12 pl). In an exemplary embodiment, a prefire pulse (also designated as a pre-ejection pulse) can be used to activate the actuator 220. Although the nozzle arrangement 200 produces a movement of the ink and an oscillation of the meniscus 210 in response to the prefire pulse, no ink droplets are ejected via the nozzle 201.

The viscosity of the ink at the nozzle 201 of a nozzle arrangement 200 may increase due to evaporation. In an exemplary embodiment, prefire pulses are used to counteract an increase in viscosity of the ink. Via a prefire pulse, the actuator 220 of a nozzle arrangement 200 is induced to move the ink within the nozzle arrangement 200 and to bring the meniscus 210 at the nozzle 201 into oscillation such that, although a mixing of the ink within the chamber 212 of the nozzle arrangement 200 occurs, an ejection of ink does not. A prefire pulse thus enables the viscosity of the ink within the nozzle arrangement 200 to be reduced without printing a "non-white" pixel.

In an exemplary embodiment, for one or more individual nozzle arrangement 200 of the printing system 100, the controller 101 may be configured to determine—based on the print data (e.g., based on a rastered image)—whether a "white" pixel or a "non-white" pixel should be printed at a specific point in time. If it is determined that a "non-white" pixel should be printed at the specific point in time, the controller 101 may determine the droplet size to be printed based on the print data. If it is determined that a "white" pixel should be printed at the specific point in time, the controller 101 may thus determine (based on the print data) whether a prefire pulse should take place at the specific point in time in order to reduce the viscosity of the ink in the nozzle arrangement 200. In an exemplary embodiment, it is advantageous to keep the number of prefire pulses as low as possible to reduce a loading of the nozzle arrangement 200 so as to reduce a possible overheating of the nozzle arrangement 200.

In an exemplary embodiment, for a pixel of a rastered image, the controller 101 is configured to determine whether:

a) a droplet of a specific size should be ejected from the nozzle arrangement 200 (in order to print a "non-white" pixel);

b) the actuator 220 of the nozzle arrangement 200 should be activated with a prefire pulse (in order to print a "white" pixel, and in order to reduce the viscosity of the ink in the nozzle arrangement); or c) no activation of the actuator 220 of the nozzle arrangement 200 should take place (in order to "print" a "white" pixel).

In an exemplary embodiment, this information may be transmitted from the controller 101 to a controller 105 of the print bar 102 that includes the activated nozzle arrangement 200. The information may be encoded (e.g., as an L-bit value, wherein L=4, for example). In an exemplary embodiment, the controller 105 is configured to select a suitable waveform to activate of the actuator 220 of the nozzle arrangement 200 based on the received information, and activate the actuator 220 according to the selected waveform. In an exemplary embodiment, the controller 105 includes processor circuitry that is configured to perform one or more functions and/or operations of the controller 105, including selecting one or more waveforms and activating the actuator(s) 220.

Figure 3:
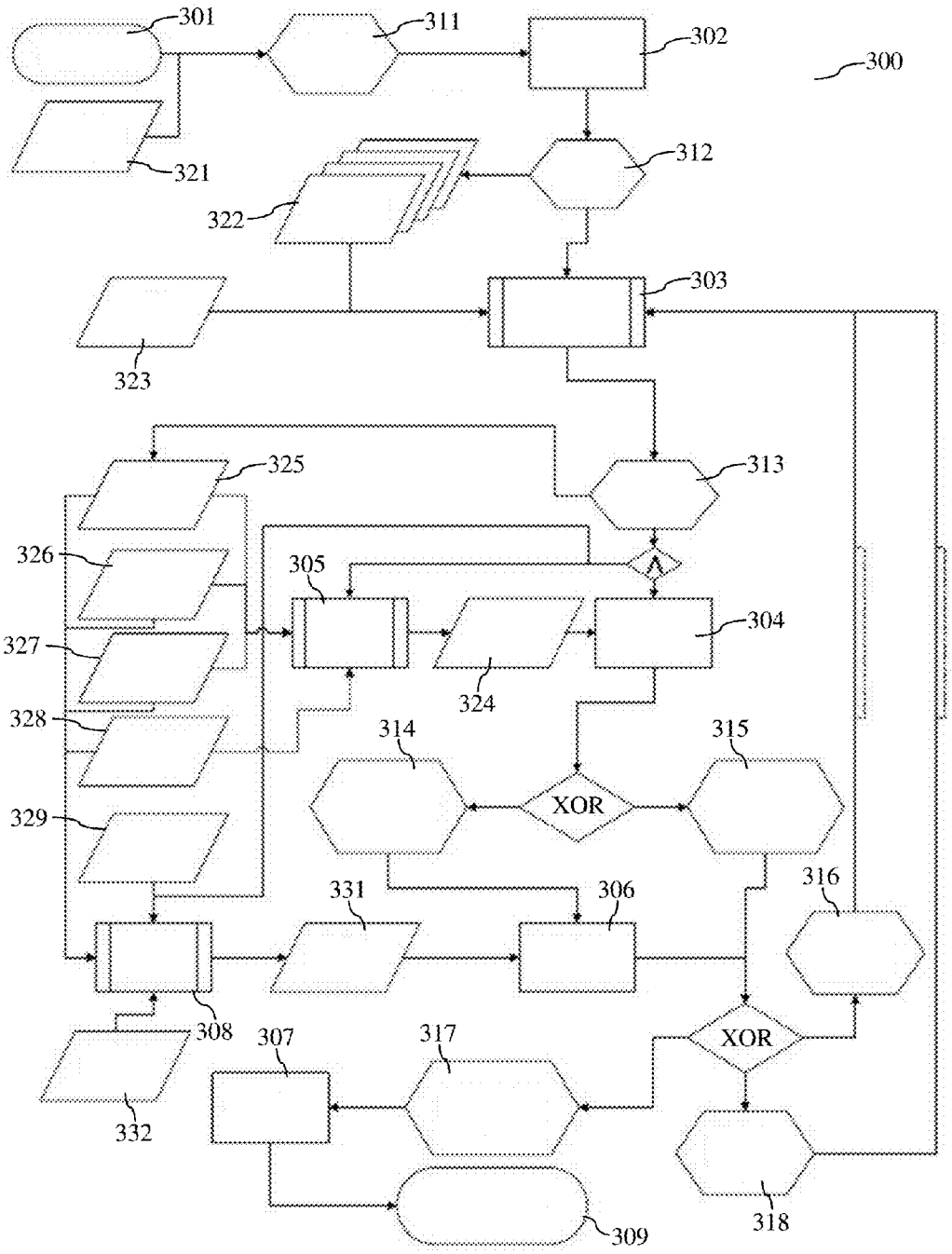
FIG. 3 illustrates a workflow diagram of a method for stabilization of the print quality of an inkjet printing system according to an exemplary embodiment of the present disclosure.

FIG. 3 illustrates a workflow diagram of a method 300 to stabilize the print quality of an inkjet printing system 100 according to an exemplary embodiment of the present disclosure. In an exemplary embodiment, the method 300 determines a number of prefire pulses that should be used for a nozzle arrangement 200 upon printing of a print image to keep the print quality of the nozzle arrangement 200 stably at a high level. In one or more exemplary embodiments, the controller 101 and/or controller 105 are configured to perform one or more operations of the method 300.

In an exemplary embodiment, the processing of an image 321 to be printed begins in step 301, and the method 300 thereupon has the status 311, "Data processing has begun." The image 321 to be printed may already be present in a rastered form (e.g., the image 321 to be printed may comprise a plurality of pixels (for example a matrix of pixels), wherein each pixel is printed in a print bar 102 of the printing system 100 via precisely one nozzle arrangement 200 of the inkjet printing system 100). In this example, the rastered image 321 comprises a plurality of pixels, wherein each pixel includes control instructions (for example in the aforementioned encoded form) for a single respective nozzle arrangement 200 of a print bar 102 of the printing system 100. In particular, the pixels of a line of the rastered image 321 are printed by the corresponding nozzle arrangements 200 of a print bar 102. This process repeats for the following lines of the rastered image 321. The pixels of a specific column of the rastered image 321 are thereby printed by a specific nozzle arrangement 200 of a specific print bar 102. In an exemplary embodiment, each pixel includes control instructions for a plurality of print bars 102 of the printing system 100 that are used. In an exemplary embodiment, the rastered image 321 may be created in a rastering and screening process based on an image template (a PDF file, for example) to be printed.

The image 321 can include a plurality of image layers 322, wherein each image layer 322 may be printed by a different print bar 102 of the printing system 100. For example, the different image layers 322 may correspond to different color components of the image 321. In step 302, the image 321 is divided up into one or more image layers 322 so that the method 300 thereupon has the status 312, "Print image divided up." An image layer 322 then comprises the control instructions for the nozzle arrangements 200 of a print bar 102 of the printing system 100.

In an exemplary embodiment, for a nozzle device 200 of a print bar 102 of the printing system 100, the method 300 additionally includes the determination 303 of a dead time 325—NPT (Non-Printing Time)—between two successive "non-white" pixels to be printed. In an exemplary embodiment, the dead time NPT 325 is determined based on the print data of the image layer 322 for the print bar 102. As presented above, the image layer 322 may comprise a matrix of pixels to be printed, wherein each column of the matrix is to be printed by a respective nozzle device 200 of the print bar 102. The dead time NPT 325 can thus be determined based on the column of the matrix that should be printed by the respective nozzle device 200. Furthermore, the dead time 325 depends on the print speed 323. In an exemplary embodiment, the dead time NPT 325 is inversely proportional to the print speed 323. For example, the dead time 325 results from the interval value described in this document (see further below) and the print speed 323 (via division). After determination of the dead time NPT 325, the method 300 is in the "NPT determined" state 313.

In an exemplary embodiment, if a dead time NPT 325 between two "non-white" pixels to be printed that reaches or exceeds a specific dead time threshold 324 has been determined for a nozzle arrangement 200, a viscosity increase of the ink within the nozzle arrangement 200 may occur and thereby cause a reduction of the print quality.

In an exemplary embodiment, the dead time threshold 324 may thereby depend on the plurality of factors. In this example, the method 300 includes a step 305 to determine the dead time threshold 324. In an exemplary embodiment, the dead time threshold 324 depends on the ink 326 that is used (e.g., on a property of the ink 326 that is used), on a climatic condition 327 (e.g., on the temperature and/or the humidity) in the environment of the nozzle arrangement 200, on a requirement 328 for the print quality (e.g., on an acceptable offset of pixels), and/or one or more other parameters as would be understood by one of ordinary skill in the relevant arts.

In an exemplary embodiment, an insertion threshold (as a number of lines) may accordingly be provided. In an exemplary embodiment, the insertion threshold is the dead time threshold 324 multiplied by the print speed. The insertion threshold typically decreases with decreasing print speed (and vice versa) (given a constant dead time threshold 324).

In an exemplary embodiment, it may then be determined 304 whether the dead time NPT 325 is greater than or equal to the dead time threshold 324. If the dead time NPT 325 is less than or equal to the dead time threshold 324 (state 315), the image layer may 322 remain unchanged. In this example, no activation of the nozzle arrangement 200 with a prefire pulse (as provided by the print data of the image layer 322) takes place during the dead time NPT 325. The controller 101 can be configured to perform the determination 304.

If it is determined that the dead time NPT 325 is greater than the dead time threshold 324 (state 314), the nozzle arrangement 200 is charged with one or more prefire pulses during the dead time NPT 325 (step 306). In other words, a prefire pulse sequence for the dead time NPT 325 may be inserted into the print data of the image layer 322. It may thus be achieved that the viscosity of the ink in the nozzle arrangement 200 is sufficiently reduced so that a high print quality is maintained, even given a (chronologically speaking) relatively long non-utilization of the nozzle arrangement 200.

In an exemplary embodiment, the prefire pulse sequence that is inserted between two successive "non-white" pixels to be printed (if the dead time NPT 325 is greater than the dead time threshold 324) may be described by a plurality of prefire parameters 331. In an exemplary embodiment, the prefire parameters 331 include one or more of:

- a number of prefire pulses in the prefire pulse sequence; and/or
- a chronological placement of the one or more prefire pulses during the dead time NPT 325.

In an exemplary embodiment, the method 300 includes the determination 308 of the prefire parameters 331. The prefire parameters 331 may be determined based on a plurality of state data, including, for example, on the ink 326 that is used (in particular on the property of the ink 326 that is used), on a climatic condition 327 (for example on the temperature and/or the humidity) in the environment of the nozzle arrangement 200, on the dead time NPT 325, and/or on a requirement 328 for the print quality (for example on an acceptable offset of pixels). In an exemplary embodiment, predefined rules 329, 332 with regard to the prefire parameters 331 (for example in the form of lookup tables) may be used in order to determine the prefire parameters 331 (and therefore the prefire pulse sequence). The predefined rules 329, 332 may associate different prefire parameters 331 with different combinations of state data. The predefined rules 329, 332 may be determined experimentally, for example.

The prefire pulse sequence corresponding to the prefire parameters 331 is inserted into the print data of the image layer 322 (step 306), such that the nozzle arrangement 200 is charged with one or more prefire pulses between the successive "non-white" pixels, according to the prefire pulse sequence. This method 300 may be implemented for some or all nozzle arrangements 200 of a print bar 102 (state 316) and for some or all image layers 322 (e.g., for all print bars 102 that are used (state 318)). If the print data for all print bars 102 and all nozzle arrangements 200 have been processed (state 317), the (modified) image layers 322 may be combined with one another again (step 307) and the processing of the print data may be concluded (step 309).

In an exemplary embodiment, the controller 101 is configured to transmit the modified print data for a (modified) image layer 322 to the controller 105 of the corresponding print bar 102. For each pixel, the modified print data of the image layer 322 indicate whether a droplet ejection should take place, and if applicable in which droplet size a droplet ejection should take place. If no droplet ejection should take place for a pixel, the print data show whether the corresponding nozzle arrangement 200 should be activated with a prefire pulse or not.

In an exemplary embodiment of a printing system 100, the number of bits of the print data (which may be transmitted from the controller 101 to the controller 105 for each pixel) may be limited to N control bits (for example N=2). In other words: the number of control signals that may be transferred from the controller 101 to the controller 105 per pixel may be limited. With L=4 control bits, for example, it may be indicated whether

- no droplet ejection should take place ("white" pixel);
- a prefire pulse should take place;
- a droplet ejection should take place with 7 pl;
- a droplet ejection should take place with 9 pl; or
- a droplet ejection should take place with 12 pl.

Via the method 300, prefire pulses may be inserted in a controlled manner depending on the print data. In particular, in preparation for an ink ejection one or more prefire pulses may be generated for nozzle arrangements 200 that have not fired any ink for a longer period of time. The print quality may thus be increased. In particular, first line effects may thus be avoided. Given a limited number L of control bits/pixel, the number of different droplet sizes may be reduced (by precisely one droplet size) if applicable for the encoding of a prefire pulse. For example, given L=2 the instructions "no droplet ejection", "prefire pulse" as well as droplet ejection with two different droplet sizes may be encoded.

In an exemplary embodiment, the method 300 may be realized via a comprehensive analysis of the print data of a print image. In an exemplary embodiment, an efficient hardware implementation (e.g., a field-programmable gate array (FPGA)) of the method 300 (in modified and/or simplified form) is described in the following.

FIG. 4 shows a circuit 400 for a printing system 100 according to an exemplary embodiment of the present disclosure. The circuit 400 may be a hardware circuit, and may be configured to analyze the print data stream continuously (or in some embodiments, periodically) during the printing and, depending on the print image (i.e. depending on the image plane 322), to insert prefire pulses into the print data 401, 403 to provide modified print data 404.

In an exemplary embodiment, the hardware circuit 400 comprises three circuit modules 411, 412, 413:

- a module (A) 411 (also designated as an analyzer) to analyze the print data 401 and to provide analysis data 402;
- a module (B) 412 which comprises a data buffer to delay the print data 401 and to provide delayed print data 403; and
- a module (C) 413 (also designated as a prefire inserter) to insert prefire pulses into the delayed print data 403 and to provide modified print data 404.

In an exemplary embodiment, the analyzer 411, the buffer 412, and/or the inserter 413 includes processor circuitry configured to perform one or more respective operations and/or functions of the analyzer 411, the buffer 412, and/or the inserter 413.

In an exemplary embodiment, the analysis of the print data 401 and the insertion of prefire pulses thereby takes place during the passing of the print data 401 to a print head 103. In particular, for this purpose the hardware circuit 400 may be implemented as part of the controller 105.

In an exemplary embodiment, the analyzer 411 is configured to receive the print data 401 and pass the print data to the downstream data buffer 412. The print data 401 are analyzed (line by line) while they pass through analyzer 411. Analyzer 411 knows—using the position (i.e. the column) of a print dot within a line of the print data 401—for which nozzle arrangement 200 the respective print dot is intended. Based on this, it is a task of analyzer 411 to measure, for each nozzle arrangement 200, the interval (i.e. the firing interval) as a number of lines between two successive fire pulses (i.e. between two successive "non-white" pixels). In particular, analyzer 411 may determine whether a nozzle arrangement 200 should generate a fire pulse in a current line, and whether the last preceding fire pulse of the nozzle arrangement 200 is further in the past than an interval value threshold N.

Figure 5:
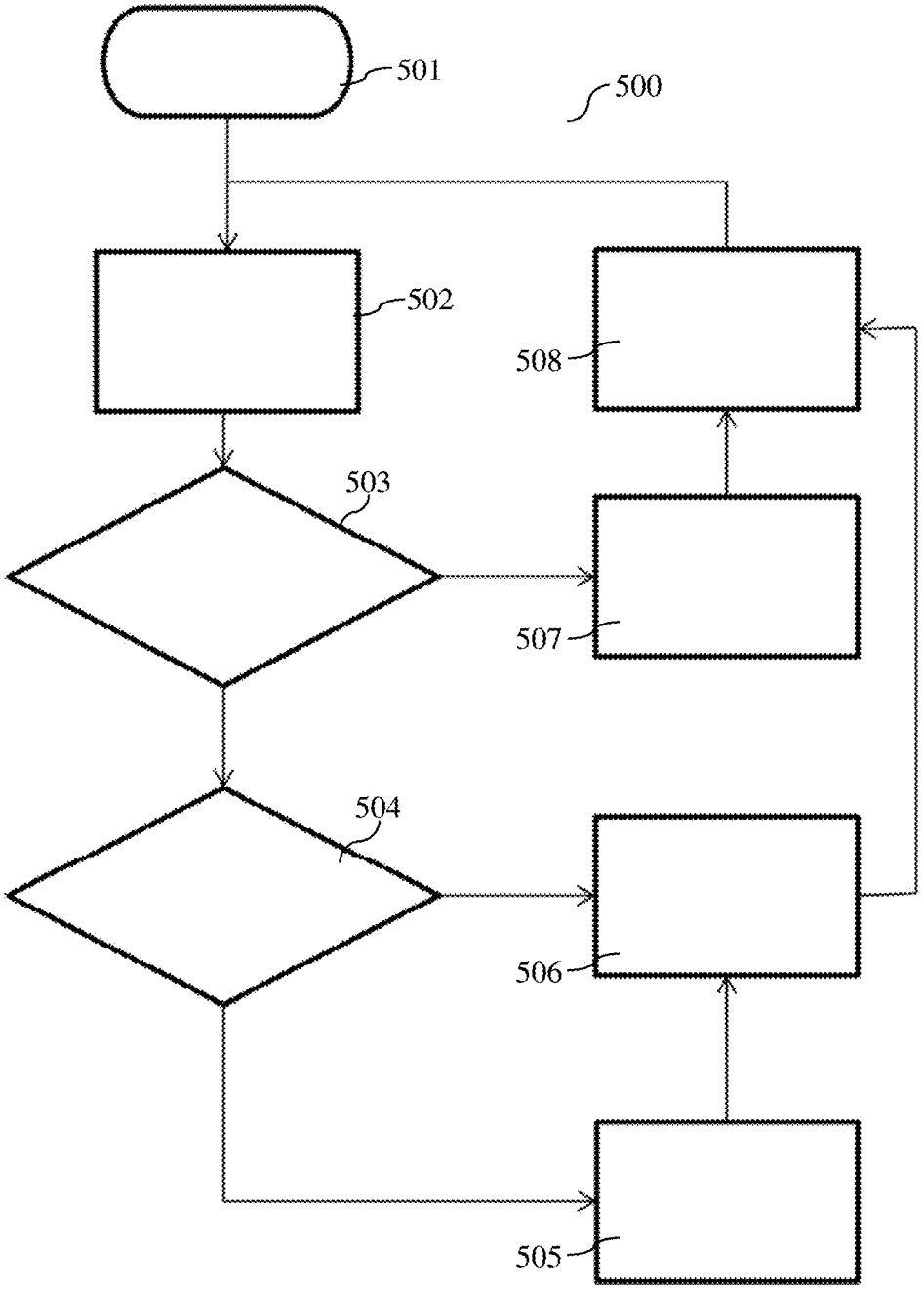
FIG. 5 illustrates a workflow diagram of a method to determine an interval value or a dead time according to an exemplary embodiment of the present disclosure.

In an exemplary embodiment, for this, analyzer 411 may execute the method 500 from FIG. 5. After the printing starts at 501, the print dot is determined in a current line "x" for a nozzle arrangement "y". It is then determined whether the nozzle arrangement "y" should generate a fire pulse in the line "x" (step 503). If this is not the case, an interval value (for example a counter i) for the nozzle arrangement "y" is increased by one (step 507), meaning that i is increased to i+1. As shown in FIG. 6*a*, this may take place via an adding group. The process then waits for the print dot for the nozzle arrangement "y" in the next line "x+1" (step 508).

If a fire pulse should be generated in the current line "x" by the nozzle arrangement "y", it is determined whether the interval value (for example the counter i) for the nozzle arrangement "y" is greater than a value N (step 504). The value N may be designated as an interval value threshold. Furthermore, the value N corresponds to the depth of the data buffer of module (B) 412. A region of N lines thus results in order to insert a prefire pulse. The interval value threshold N thus corresponds to the maximum length of a prefire pulse sequence that may be inserted for the lines "x−1" through "x−N" before the printing of a "non-white" pixel in the current line "x". It may thereby be the case that the number of "white" lines before the current line "x" is greater than N. The interval value threshold N is typically chosen to be sufficiently large in order to ensure that a nozzle arrangement 200 may be reliably cleaned via a prefire pulse sequence with N prefire pulses. On the other hand, the interval value threshold N is typically chosen to be as small as possible in order to keep the data buffer small.

If the interval value (for example the counter i) for the nozzle arrangement "y" is not greater than N, the interval value (for example the counter i) is thus set to zero again (step 506). On the other hand, information about the fact that the interval value (for example the counter i) for the nozzle arrangement "y" is greater than N is sent as analysis data 402 to inserter 413 (step 505). In particular, the measured interval value (i.e. a counter value that is greater than N) may be sent as analysis data 402 to inserter 413 (step 505).

In other words, if no fire pulse is detected in the print data 401 within the current line "x" to be analyzed for a nozzle arrangement "y", the counter i is incremented by 1 for the relevant nozzle arrangement "y". If a fire pulse is detected in the print data 401 within the current line "x" to be analyzed for a nozzle arrangement "y", the interval measurement for this nozzle arrangement "y" is concluded. If the interval value that is determined for the appertaining nozzle arrangement "y" is greater than the depth N of the data buffer in module (B) 412, the interval value that is determined for this nozzle arrangement "y" is immediately communicated to inserter 413 without the detour via the data buffer in module (B). The interval value is subsequently reset to 0 for the appertaining nozzle arrangement "y" and a new interval measurement is begun.

In an exemplary embodiment, via the relaying (e.g., immediate relaying) of the interval values of analyzer 411 to inserter 413, the following information is supplied to inserter 413:

- The considered nozzle arrangement "y" fires in the current line processed by analyzer 411; and/or
- The information about how many lines it has been since the appertaining nozzle arrangement last fired before the current line "x".

In an exemplary embodiment, the analyzer 411 thereby measures and administers the interval value for each nozzle arrangement independently.

In an exemplary embodiment, buffer 412 is a data buffer that is configured to delay the print data 401 by N lines to transmit print data 403, delayed by N lines, to inserter 413 (see FIG. 6*b*). The data buffer may be memory in one or more embodiments.

In an exemplary embodiment, all (or some) print lines that are transferred from analyzer 411 to inserter 413 pass through data buffer 412. The size of the print data buffer 412 may be set during a configuration phase of the printing system 100. After the configuration, the number N of print lines that are simultaneously located in the print data buffer 412 is fixed, and typically can no longer be changed. Before the start of printing, the buffer 412 is filled with the set number N of lines.

During the print operation, the data buffer 412 always contains the constant, preset number N of print lines. For example, this is achieved via a line-oriented operating mode of the data buffer 412. This operating mode prescribes that for each line "x" which is being read at the output, a new line "x+N+1" always must be saved in the buffer before a new line can be read.

Due to the continuous, constant fill level in the print operation, it is ensured that there is a fixed interval between the line "x+N" at the input and the line "x" at the output of the buffer module 412. Given a fill state of N lines, the difference between the line number at the input and the line number at the output is N lines. Via the operating mode of the data buffer 412 it is achieved that the data buffer delays the data between analyzer 411 and inserter 413 by precisely N print lines.

In an exemplary embodiment, the data buffer 412 is configured to delay the print data 401 by a fixed number N of print lines. As a consequence, inserter 413 processes the line "x−N−1" while analyzer 411 processes the line "x".

In an exemplary embodiment, inserter 413 receives the delayed print data 403 from the data buffer 412 and passes the delayed print data 403 on in the direction of the print head 103. If necessary, prefire pulses are inserted into the data stream while the print data 403 thereby pass through inserter 413.

In an exemplary embodiment, the decision as to whether inserter 413 inserts one or more prefire pulses (or what is known as a prefire pulse sequence) for a nozzle arrangement "y" is based on the transmitted interval information in the analysis data 402 of analyzer 411 for the corresponding nozzle arrangement "y". The interval information of analyzer 411 is thereby based on the line "x" that is presently being processed by analyzer 411. Since the difference of the processed line between analyzer 411 and inserter 413 amounts to N print lines, due to the interposed data buffer (B) 412, inserter 413 receives information about a line "x" that it only processes or relays N+1 lines later.

In an exemplary embodiment, in the analysis data from analyzer 411, for each nozzle arrangement "y" inserter 413 receives the following information in order to make a decision about the insertion of a prefire pulse sequence:

- Inserter 413 knows when, in the analysis data 402, an interval value (or corresponding information) for a nozzle arrangement "y" has been transmitted that this nozzle arrangement "y" will fire in N+1 lines;
- Inserter 413 additionally knows that this nozzle arrangement "y" will not fire for the next N lines since only firing intervals that are greater than the depth N of data buffer (B) are transmitted; and
- Inserter 413 knows, using the firing interval value, how many lines previously the nozzle arrangement fired the last time.

In an exemplary embodiment, the insertion of a prefire pulse sequence may be controlled independently in inserter 413 for each nozzle arrangement "y". For this purpose, inserter 413 may administer two main states for each nozzle arrangement "y": a transparent state or a prefire state.

In an exemplary embodiment, at the beginning of the print operation, each nozzle arrangement 200 of a print head 103 is found in a transparent state. In this state, the print data 403 for the corresponding nozzle arrangement 200 are relayed without modification in the modified print data 404 to the nozzle arrangement 200.

In an exemplary embodiment, if inserter 413 receives the firing interval value, communicated by analyzer 411 for a nozzle arrangement 200, the state of this nozzle transitions into the prefire state. At this point, inserter 413 knows that the appertaining nozzle arrangement 200 will fire in N+1 lines, and that this nozzle arrangement 200 will not fire the next N lines (thus will also generate no print image). In this state, a suitable prefire pulse sequence may be inserted into the modified print data 404 for the next N lines (as well as possibly for the line currently processed by inserter 413) without adulterating the rastered print image. The transparent state for the appertaining nozzle arrangement 200 is reached again after N+1 lines, precisely when the fire pulse for which advance notice was given by analyzer 411 reaches inserter 413 in the print data 403.

Inserter 413 thus receives information from analyzer 411 about a line "x" that is only processed N+1 lines later by inserter 413. During this time, inserter 413 may manipulate the print data 403 of the individual nozzle arrangements 200.

The hardware circuit 400 thus enables an efficient print data-dependent insertion of a prefire pulse sequence.

FIGS. 6*a*, 6*b*, and 6*c* respectively illustrate exemplary embodiments of the analyzer 411, data buffer 412, and inserter 413.

In an exemplary embodiment, the analyzer 411 and/or the inserter 413 are implemented as FPGAs. The FPGAs can comprise a plurality of different hardware components, including, for example, memory (e.g, RAM), logic elements, registers, flip-flops, and/or other circuits and/or processors.

In an exemplary embodiment, an FPGA can include a reduced number of components (e.g., less than K components corresponding to the K nozzle arrangements 200). In this example, the FPGA is configured for certain functions for k nozzle arrangements 200, wherein k=K/F with F=10, 20, 30 or more. In an exemplary embodiment, storage units 612, 632 are memory (e.g., RAM or FIFOs). The storage units 612, 632 can store data for the K nozzle arrangements 200 or k nozzle arrangements 200.

Turning to FIG. 6*a*, the print data 401 may be divided up into individual data words for a subset of k pixels of a line. In an exemplary embodiment, analyzer 411 therefore does not need to simultaneously determine the firing interval values for all K nozzle arrangements 200 of a print head 103 or of a print line, but rather only for the k nozzle arrangements 200 of the current data word to be processed.

In an exemplary embodiment, in order to determine and to administer the firing interval values, analyzer 411 comprises k adding groups 611 (also referred to as "adding units" 611) and a memory 612 (e.g., RAM). The memory 612 contains an entry for each of the K nozzle arrangements 200, wherein the respective entry includes the firing interval value for the appertaining nozzle arrangement 200.

Via the position of a pixel within a print line or within a data word, the nozzle arrangement 200 associated with this is unambiguously established, and therefore the corresponding entry in memory 612. In an exemplary embodiment, for each data word that passes through analyzer 411, the following workflow may be implemented:

- For each pixel of the current data word, analyzer 411 reads the firing interval value 613 belonging to this from memory 612.
- For each pixel of the current data word, analyzer 411 updates the firing interval value 613 corresponding to the method 500 described above.
- For each pixel of the current data word, analyzer 411 then writes the updated firing interval value 613 back into memory 612.

For an efficient realization, the data width of the firing interval values memory 612 (also designated as an analyzer memory unit) may be selected so that each word of the memory 612 contains k firing interval values 613, 614. Per print data word, only one word must thereby be read out of the memory 612, and only one word must be written into the memory 612 by the adding unit 611 after updating the firing interval values 613, 614. With the assistance of a dual-ported memory 612, the reading of the word n+1 (i.e. the reading of the firing interval value 613 for a following set of k pixels) and the writing of the updated value n (i.e. the writing of the updated firing interval values 614 for a current set of k pixels) are possible in parallel.

For example, the interval values 613 may be stored at successive addresses in memory 612 given linear order of the nozzle arrangements 200 in the print data 401. F (with F=K/k) words then result in memory 612 at (if applicable) addresses in direct consecutive order.

For example, k=16 pixels may be transferred per data word, such that there are k=16 adding units 611 that are used to update 16 firing interval values 613 in parallel. In this case, for example, the pixels 0-15 are transferred in data word 0, the pixels 16-31 are transferred in data word 1 etc., up to (K−k)−(K−1) in data word (F−1). The memory 612 may be configured such that the counters or interval values for the nozzle arrangements 0-15 are arranged at the address 0, the counters or interval values for the nozzle arrangements 16-31 are arranged at the address 1, and so on. A read access to address 0 of the memory 612 is used to load all counter values 613 belonging to the data word 0 from the memory 612. After the updating of the counter values 613 by the k=16 adding units 611, the updated counter values 614 are stored in the memory 612 via a write access to address 0.

The counter values 613 belonging to the data word 1 are located at address 1 in RAM memory. For this data word and for all additional data words of the current print line, the process is analogous to that of data word 0. The processing subsequently continues with data word 0 of the next print line. The counter values or interval values that belong to this are located at address 0 of the memory 612.

In an exemplary embodiment, due to the use of a memory 612 to store the firing interval values 613, an adding unit 611 is not required for every nozzle arrangement 200, but rather only k adding units 611 (one per pixel of a data word). This enables a resource-preserving implementation of analyzer 411 (e.g., with the aid of an FPGA). Alternatively, a FIFO may also be used instead of RAM for the administration of the counter states. The number k typically depends on the word width of a data path and/or the underlying pixel encoding. The implementation shown in FIG. 6*a* is possible for different word widths and/or pixel encodings.

Analogous to the configuration of the analyzer 411, the inserter 413 of an exemplary embodiment is illustrated in FIG. 6*c*. In an exemplary embodiment, the inserter 413 includes a state logic 631 that implements the state transition from the transition state to the prefire state and vice versa for each nozzle arrangement 200. Analogous to the operating mode of analyzer 411, the state logic 631 does not need to process the states of all nozzle arrangements 200 simultaneously, but rather only the states of k nozzle arrangements 200. The number k thereby corresponds to the pixel count in one data word.

In an exemplary embodiment, inserter 413 administers an entry into a memory 632 for each nozzle arrangement 200 of a print head 103 or of a print bar 102. Each memory entry includes the current state 633 of the appertaining nozzle arrangement 200 and a counter value belonging to this. For each data word that passes through inserter 413, the state logic 631 loads the k states 633 and counter values belonging to this from the memory 632. With the aid of the current state 633 and the interval information 402 from analyzer 411, the state logic 631 implements a state transition as needed. The k updated states and counter values 634 are subsequently stored again in memory 632.

In an exemplary embodiment, for an efficient realization, the data width of the memory 632 may be chosen so that each word of the memory 632 includes k state entries. Furthermore, the entries may be grouped in memory so that all entries for the pixels in data word n are located at address n. Only one read operation is thereby necessary in order to read the k states 633 for the nozzle arrangements 200 of the current data word to be processed and to store them again in memory 632 via a write operation after an update has taken place. The reading of word n+1 and the writing of the updated word n are possible in parallel with the aid of a dual-ported memory 632.

In a transparent state, the counter value stored in the memory 632 is not considered in addition to the actual state 633 of a nozzle arrangement 200. In the prefire state, the counter value includes the current interval in the print lines of the appertaining nozzle arrangement 200 until the next fire pulse. The counter value of the data buffer (B) 412 is initialized with depth N via the transition from the transparent state to the prefire state. If a nozzle is in the prefire state, via the state logic 631 the counter value is decremented by one with every processed print line.

In an exemplary embodiment, inserter 413 includes a prefire insertion logic 635 that receives from the state logic k states 633 for the k pixels of the current data word. If a nozzle arrangement 200 is in the transparent state, the pixel for this nozzle arrangement 200 is relayed on without modification. If a nozzle is in the prefire state, "white" pixels are replaced with prefire pulses if applicable. The counter value administered in addition to the state 634 of a nozzle arrangement 200 may be used to select the pattern for a prefire pulse for the current line.

Via the use of a memory 632 to store the states 633 and counter states, one state logic 631 is not required for each of the K nozzle arrangements 200, rather only k state logics 631—one per pixel of a data word. This enables a resource-preserving implementation of inserter 413 with the aid of an FPGA. Alternatively, instead of memory 632, a FIFO may also be used for the administration of the states 633. The number k depends on the word width of the data path and/or of the underlying pixel encoding. The implementation is possible for the most different word widths and/or pixel encodings.

FIGS. 7*a* and 7*b* illustrate an exemplary implementation of circuit 400 in the printing system 100 according to an exemplary embodiment. In an exemplary embodiment, circuit 400 may be implemented as part of the controller 105 (for example as part of a print head control assembly). Parts of the circuit 400 may thereby be implemented in an FPGA 705. In an exemplary embodiment, the FPGA 705 may have an interface 701 to the controller 101 to receive the print data 401 and an interface 704 to the print head 103 for relaying the modified print data 404. Controller 105 for a print head 103 of an inkjet printing system 100 is described in more detail below.

In an exemplary embodiment, the print head 103 comprises at least one nozzle arrangement 200 that may be activated in order to generate a fire pulse for an ink ejection, or a prefire pulse without ink ejection. Given a prefire pulse, an ink meniscus 210 at a nozzle 201 of the nozzle arrangement 200 is thereby typically set into oscillation, but no ejection of the ink from the nozzle arrangement 200 takes place. The print head 103 or the inkjet printing system 100 may in particular have a nozzle arrangement 200 (in a one-to-one association) for each column of a rastered image 321.

In an exemplary embodiment, the controller 105 comprises an analyzer 411 that is configured to analyze basic print data 401 for a rastered image 321 in order to detect a current line of a sequence of lines of the rastered image 321 in which the nozzle arrangement 200 should generate a fire pulse, and for which an interval value 613 of directly preceding lines of the sequence of lines in which the nozzle arrangement 200 should have generated no fire pulse is greater than a predefined interval value threshold N. In an exemplary embodiment, the interval value threshold N may thereby be chosen such that no substantial losses in print quality due to viscosity changes of the ink are to be feared for interval values 613 that are smaller than the interval value threshold N. On the other hand, interval values 613 that are greater than the interval value threshold N (in particular greater than the insertion threshold) lead to a reduction in the print quality. In an exemplary embodiment, the interval value threshold N and the insertion threshold may depend on conditions in the environment of the nozzle arrangement 200 (for example the temperature and/or the humidity). Moreover, the interval value threshold N indicates the maximum length of a prefire pulse sequence that may be inserted into the print data 401.

In an exemplary embodiment, for a line of the rastered image 321, the basic print data 401 typically include a control instruction that indicates whether the nozzle arrangement 200 should generate a fire pulse for an ink ejection. Furthermore, the control instruction indicates whether the nozzle arrangement 200 should generate no pulse in order to print a "white" pixel. Furthermore, the control instruction typically does not indicate whether the nozzle arrangement 200 should generate a prefire pulse without ink ejection. In other words, the basic print data 401 typically include no control instructions for the generation of prefire pulses.

It is noted that the terms "line" and "column" may respectively be exchanged (depending on the orientation of the rastered image 321). In the present disclosure, a line of the rastered image 321 corresponds to a set of K pixels that are printed (substantially simultaneously) by K nozzle arrangements 200 of a print head 103 or of a print head arrangement 102. Individual nozzle arrangements 200 are identified by a column of the rastered image 321.

In an exemplary embodiment, the controller 105 additionally comprises a data buffer 412 that is configured to delay the basic print data 401 by N lines in order to provide delayed print data 403.

In an exemplary embodiment, the controller 105 comprises a prefire inserter 413 that is configured to determine the modified print data 404 on the basis of the delayed print data 403 for at least one past line of the sequence of lines that is situated up to N lines before the current line, such that the modified print data 404 induce the nozzle arrangement 200 to generate a prefire pulse for the past line. Furthermore, the controller 105 may be configured to send the modified print data 404 to the nozzle arrangement 200.

In an exemplary embodiment, via the controller 105, one or more prefire pulses may thus be inserted efficiently and selectively only as needed. The print quality of the printing system 100 may thus be increased while saving resources.

In an exemplary embodiment, the analyzer 411 may be configured to provide analysis data 402 for the current line, wherein the analysis data 402 indicate that the interval value 613 from directly preceding lines is greater than the predefined interval value threshold N. In particular, the analysis data 402 may indicate (possibly may only indicate) the respective current lines for which the conditions apply that:

- the nozzle arrangement 200 should generate a fire pulse in the current line, and
- an interval value 613 from directly preceding lines before the current line, in which the nozzle arrangement 200 should have generated no fire pulse, is greater than the predefined interval value threshold N.

In an exemplary embodiment, the analysis data 402 may (if applicable) additionally indicate the concrete interval value 613 (in particular if the interval value 613 is greater than the interval threshold N or a predefined insertion threshold). The concrete interval value 613 may then be used by the prefire inserter 413 to select a suitable prefire pulse sequence for the up to N preceding lines. For example, the number of inserted prefire pulses may increase with the interval value 613. In an exemplary embodiment, the concrete interval value 613 may be compared with the predefined dead time threshold 324 or with an insertion threshold, wherein the insertion threshold may correspond to the dead time threshold 324 multiplied by the print speed. In an exemplary embodiment, the prefire pulse sequence may depend on whether the concrete interval value 613 is greater than or less than the insertion threshold. For example, the prefire inserter 413 may be configured to only insert a prefire pulse sequence when the interval value 613 is greater than or equal to the insertion threshold. Alternatively or additionally, the prefire inserter 413 may be configured to adapt the inserted prefire pulse sequence depending on the interval value 613. For example, the length of the inserted prefire pulse sequence may increase with increasing interval value 613 (up to the maximum possible length N).

In an exemplary embodiment, the interval value threshold N (as a number of lines) is thereby typically smaller than or equal to the insertion threshold. The required data buffer may be reduced (given consistently high print quality) via the selection of a relatively small interval value threshold N.

In an exemplary embodiment, the prefire inserter 413 may be configured to determine the modified print data 404 (possibly exclusively) depending on the analysis data 402 (and depending on the delayed print data 403). A decoupling of analyzer 411 and prefire inserter 413 to the greatest possible extent, and a correspondingly efficient implementation of the controller 105, are thus possible.

In an exemplary embodiment, the prefire inserter 413 may be configured to determine a state value 633 for the nozzle arrangement 200 depending on the analysis data 402. The state value 633 may thereby include a transparent state or a prefire pulse state. In an exemplary embodiment, the prefire inserter 413 may be configured to transition the state value 633 from the transparent state into the prefire pulse state when the analysis data 402 (for a current line) indicate that—for the current line—the interval value 613 from directly preceding lines without fire pulse is greater than the predefined insertion threshold (and that the nozzle arrangement 200 should generate a fire pulse in the current line). In an exemplary embodiment, the insertion threshold is thereby typically greater than or equal to N. Furthermore, the prefire inserter 413 may be configured to transition (i.e. to reset) the state value 633 of the nozzle arrangement 200 from the prefire state into the transparent state N+1 lines after the current line.

In an exemplary embodiment, the prefire inserter 413 may thus efficiently change a state value 633 for a nozzle arrangement 200 between the transparent state and the prefire state. The prefire inserter 413 may then insert a prefire pulse or not, depending on the state value 633. In an exemplary embodiment, the prefire pulse inserter 413 may comprise a prefire insertion logic 635 that, for a specific line, is configured to accept the modified print data 404 without any modification of the delayed print data 403 if the state value 633 indicates the transparent state. Otherwise, the prefire insertion logic 635 may be configured to determine modified print data 404 for the specified line in order to induce the nozzle arrangement 200 to generate a prefire pulse if the state value 633 indicates the prefire state. The insertion of a prefire pulse may thus be efficiently controlled via the determination of a state value 633.

In an exemplary embodiment, the prefire inserter 413 may comprise an inserter memory unit 632 that is configured to store K state values 633 for K columns of the rastered image 321. For example, the inserter memory unit 632 may comprise a RAM (random access memory) and/or a FIFO (first in first out) storage. In an exemplary embodiment, the prefire inserter 413 may comprise k state logic units 631 that are configured to update the state values 633 fork columns of the rastered image 321, with k<K. For one (in particular for any) line of the sequence of lines, the k state logic units 631 may furthermore be configured to read k previous state values 633 from the inserter memory unit 632, to update the k previous state values 633 depending on the analysis data 402, and to write k update state values 633 into the inserter memory unit 632.

In an exemplary embodiment, the number of state logic units 631 may be reduced via the division of a line with K columns into sub-units with k columns. An efficient implementation of the prefire inserter 413 may thus be realized in, for example, an FPGA.

In an exemplary embodiment, the analyzer 411 can be configured to determine—on the basis of control instructions in the basic print data 401, and sequentially line by line—whether the nozzle arrangement 200 should generate a fire pulse or not. Furthermore, if it determined that the nozzle arrangement 200 should generate a fire pulse in the current line, the analyzer 411 may be configured to determine whether the interval value 613 of directly preceding lines of the sequence of lines in which the nozzle arrangement 200 should have generated no fire pulse is greater than the predefined interval value threshold N. This information may be determined from an analyzer memory unit 612 or from an adding unit 611 of the analyzer 411. Furthermore, the analyzer 411 may be configured to provide analysis data 402 for the current line (possibly to send them to the prefire inserter 413) if the aforementioned conditions are satisfied for the current line.

In an exemplary embodiment, the analyzer 411 and the prefire inserter 413 may thus be configured to process the respective print data 401, 403 sequentially, line by line, and to thereby insert prefire pulses as needed. The controller 105 thus enables a determination and provision of the modified print data 404 in real time.

In an exemplary embodiment, analogous to the prefire inserter 413, the analyzer 411 may comprise an analyzer memory unit 612 (for example a RAM and/or FIFO storage) that is configured to store K interval values 613 for K columns of the rastered image 321. Furthermore, the analyzer 411 may comprise k adding units 611 that are configured to update interval values 613 fork columns of the rastered image 321, with k<K. For one line of the sequence of lines, the k adding units 611 may in particular be configured to read k previous interval values 613 from the analyzer memory unit 612, to update the k previous interval values 613 depending on the basic print data 401, and to write k updated interval values 614 into the analyzer memory unit 612. An efficient implementation of the analyzer 411 in a standard electronic module (for instance in an FPGA) may thus be realized.

In an exemplary embodiment, a method for increasing the print quality in an inkjet printing system 100 can include: the analysis of basic print data 401 for a rastered image 321 in order to detect a current line of a sequence of lines of the rastered image 321 in which the nozzle arrangement 200 should generate a fire pulse, and for which an interval value 613 from directly preceding lines of the sequence of lines in which the nozzle arrangement 200 should have generated no fire pulse is greater than a predefined interval value threshold N.

In an exemplary embodiment, the method additionally includes the delaying of the basic print data 401 by N lines in order to provide delayed print data 403. Furthermore, the method includes the determination of modified print data 404 on the basis of the delayed print data 403 for a past line of the sequence of lines that is located up to N lines before the current line, such that the modified print data 404 induce the nozzle arrangement 200 to generate a prefire pulse for the past line.

In an exemplary embodiment, circuit 400 (e.g., hardware (HW) circuit) implemented as controller 105 has many advantages. For example, all parts of the circuit 400 process the print data 401 during the relaying to the following modules, such that no interruption of the printing capacity occurs given an activated circuit 400. The capacity of the circuit 400 is independent of the print image, and in particular independent of how many prefire pulses must be inserted. The circuit 400 requires only a relatively small size of the data buffer 412 since the data buffer 412 stores only N lines of the print data 401. A storage of complete print pages is not necessary. The circuit 400 operates across page boundaries, meaning that an application of the function across a complete print job (with continuous feed of a web-shaped recording medium 120) is possible. Furthermore, the circuit 400 enables the control SW of the controller 101 to be left unchanged, since the prefire pulses are only inserted into the print data 404 by a circuit 400 just before the print head 103.

Furthermore, the circuit 400 as a hardware (HW) circuit has diverse advantages in comparison to a software (SW) implementation (in particular within the scope of a rastering process). In particular, an increase of the number L of bits/pixels that could be required by an additional prefire pulse would lead to an increased storage requirements given a SW solution (in particular given a correspondingly adapted rastering process). This is avoided given the implementation in a controller 105 as is described in this document. A typical rastering process operates with a page orientation. The application of prefire pulses across a complete print job is therefore typically not directly possible. Furthermore, the consideration of prefire pulses requires an additional processing step in a rastering process, which requires a portion of the available raster processing capacity. In an exemplary embodiment, one or more functions and/or operations of the circuit 400 can be realized in software. For example, the implementation can be a hardware implementation, a software implementation, or a combination of both.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, processor circuitry can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

100 printing system
101 controller of the printing system 100
102 print head arrangement/print bar
103 print head
104 print head segment
105 controller of a print head arrangement
120 recording medium
200 nozzle arrangement
201 nozzle
202 wall
210 meniscus
212 chamber
220 actuator (piezoelectric element)
221, 222 deflection of the actuator
300 method to insert prefire pulses
301, 302, 303, 304, 305, 306, 307, 308, 309 method steps
311,312,313,314,315,316,317,318 states
321 rastered image
322 image layer
323 print speed
324 dead time threshold
325 dead time
326 ink
327 climatic condition
328 requirement for print quality
329, 332 rules for determining prefire parameters
331 prefire parameter
400 hardware circuit
401 print data
402 analysis data (interval values)
403 delayed print data
404 modified print data
411, 412, 413 modules of the hardware circuit
500 method to determine an interval value
501, 502, 503, 504, 505, 506, 507, 508 method steps
611 adding group
612, 632 memory unit (RAM, FIFO)
613, 614 interval values
631 state logic
633, 634 states
635 prefire insertion logic
701, 704 interfaces
705 FPGA

What is claimed is:

1. A controller adapted for a print head of an inkjet printing system, the print head including at least one nozzle arrangement configured to be activated to generate a fire pulse for an ink ejection or a prefire pulse without ink ejection, the controller comprising:

an analyzer that is configured to analyze basic print data for a rastered image to detect:

a current line of a sequence of lines of said rastered image in which the at least one nozzle arrangement should generate a fire pulse, and whether an interval value is greater than a predefined interval value threshold N, the interval value being of directly preceding lines of the sequence of lines in which the nozzle arrangement should have generated no fire pulse;

a data buffer that is configured to delay the basic print data by N lines to provide delayed print data; and a prefire inserter that is configured to:

determine modified print data modified based on the delayed print data for a past line of the sequence of lines that is situated up to N lines before the current line, wherein the modified print data induces the at least one nozzle arrangement to generate a prefire pulse for the past line; and provide the modified print data to the at least one nozzle arrangement.

2. The controller according to claim 1, wherein:

the analyzer is further configured to provide analysis data for the current line, the analysis data indicating that the interval value of directly preceding lines is greater than the predefined interval value threshold N; and the prefire inserter is further configured to determine the modified print data based on the analysis data.

3. The controller according to claim 2, wherein:

the prefire inserter is further configured to determine a state value based on the analysis data for the at least one nozzle arrangement;

the state value comprises one of a transparent state and a prefire state; and the prefire inserter is further configured to transition the state value from the transparent state into the prefire state if the analysis data indicates that, for the current line, the interval value of directly preceding lines is greater than a predefined insertion threshold.

4. The Controller according to claim 3, wherein the prefire inserter is configured to transition the state value of the at least one nozzle arrangement from the prefire state into the transparent state N lines after the current line.

5. The Controller according to claim 4, wherein the prefire inserter is configured to transition the state value of the at least one nozzle arrangement from the prefire state into the transparent state N lines after the current line.

6. The controller according to claim 4, wherein the basic print data for a line of the rastered image comprises a control instruction that:

indicates whether the at least one nozzle arrangement should generate a fire pulse for an ink ejection;

indicates whether the at least one nozzle arrangement should generate no pulse in order to print a white pixel; and does not indicate whether the at least nozzle arrangement should generate a prefire pulse without ink ejection.

7. The controller according to claim 3, wherein the prefire inserter comprises prefire insertion logic that is configured to:

to accept print data for a specific line from the delayed print data without modification if the state value indicates the transparent state; and to determine modified print data for the specific line to induce the at least one nozzle arrangement to generate a prefire pulse if the state value indicates the prefire state.

8. The controller according to claim 3, wherein the prefire inserter comprises:

inserter memory that is configured to store K state values for K columns of the rastered image; and k state logic units that are configured to:

update state values for k columns of the rastered image, wherein k<K, and for a line of the sequence of lines:

read k previous state values from the inserter memory, update the k previous state values based on the analysis data, and write k updated state values to the inserter memory.

9. The controller according to claim 2, wherein the analyzer is configured to:

determine, based on control instructions in the basic print data and sequentially, line by line, whether the at least one nozzle arrangement should generate a fire pulse;

if it is determined that the at least one nozzle arrangement should generate a fire pulse in the current line, determine whether the interval value of directly preceding lines of the sequence of lines in which the at least one nozzle arrangement should have generated no fire pulse is greater than the predefined interval value threshold N; and if it is determined that the interval value of directly preceding lines is greater than the predefined interval value threshold N, provide analysis data for the current line.

10. The controller according to claim 2, wherein the analyzer comprises:

an analyzer memory that is configured to store K interval values for K columns of the rastered image; and k adding groups that are configured to:

update interval values for k columns of the rastered image, wherein k<K; and for a line of the sequence of lines:

read k previous interval values from the analyzer memory;

update the k previous interval values based on the basic print data; and write k updated interval values to the analyzer memory.

11. The controller according to claim 1, wherein:

the prefire inserter is further configured to determine a state value based on the analysis data for the at least one nozzle arrangement;

the state value comprises one of a transparent state and a prefire state; and the prefire inserter is further configured to transition the state value from the transparent state into the prefire state if the analysis data indicates that, for the current line, the interval value of directly preceding lines is greater than a predefined insertion threshold.

12. The controller according to claim 11, wherein the prefire inserter comprises prefire insertion logic that is configured to:

to accept print data for a specific line from the delayed print data without modification if the state value indicates the transparent state; and to determine modified print data for the specific line to induce the at least one nozzle arrangement to generate a prefire pulse if the state value indicates the prefire state.

13. The controller according to claim 1, wherein the basic print data for a line of the rastered image comprises a control instruction that:

indicates whether the at least one nozzle arrangement should generate a fire pulse for an ink ejection;

indicates whether the at least one nozzle arrangement should generate no pulse in order to print a white pixel; and does not indicate whether the at least nozzle arrangement should generate a prefire pulse without ink ejection.

14. The controller according to claim 1, wherein the analyzer is configured to:

determine, based on control instructions in the basic print data and sequentially, line by line, whether the at least one nozzle arrangement should generate a fire pulse;

if it is determined that the at least one nozzle arrangement should generate a fire pulse in the current line, determine whether the interval value of directly preceding lines of the sequence of lines in which the at least one nozzle arrangement should have generated no fire pulse is greater than the predefined interval value threshold N; and if it is determined that the interval value of directly preceding lines is greater than the predefined interval value threshold N, provide analysis data for the current line.

15. The controller according to claim 1, wherein the analyzer comprises:

an analyzer memory that is configured to store K interval values for K columns of the rastered image; and k adding groups that are configured to:

update interval values for k columns of the rastered image, wherein k<K; and for a line of the sequence of lines:

read k previous interval values from the analyzer memory;

update the k previous interval values based on the basic print data; and write k updated interval values to the analyzer memory.

16. A method to increase the print quality in an inkjet printing system including a nozzle arrangement configured to activate to generate a fire pulse for an ink ejection onto a recording medium or a prefire pulse without ink ejection, the method comprising:

analyzing basic print data for a rastered image to detect:

a current line of a sequence of lines of said rastered image in which the nozzle arrangement should generate a fire pulse, and whether an interval value is greater than a predefined interval value threshold N, the interval value being of directly preceding lines of the sequence of lines in which the nozzle arrangement should have generated no fire pulse;

delaying the basic print data by N lines to generate delayed print data;

determining, based on the delayed print data, modified print data for a past line of the sequence of lines that is situated up to N lines before the current line; and inducing the nozzle arrangement to generate a prefire pulse for the past line based on the modified print data.

17. A computer program product embodied on a computer-readable medium comprising program instructions, when executed, causes a processor to perform the method of claim 16.

18. An apparatus of an inkjet printing system configured to perform the method of claim 16.

* * * * *